United States Patent [19]

Koerssen

[11] 3,993,432

[45] Nov. 23, 1976

[54] CLEANING DEVICE FOR WALKING BEAM FURNACE

[75] Inventor: Bernard John Koerssen, Rexdale, Canada

[73] Assignee: Lee Wilson Engineering of Canada, Downsview, Canada

[22] Filed: Dec. 15, 1975

[21] Appl. No.: 640,413

[52] U.S. Cl. ..... 432/67; 432/2; 432/75

[51] Int. Cl.[2] ..... F27D 15/00

[58] Field of Search ..... 432/2, 67, 75, 122; 198/219, 229

[56] References Cited

UNITED STATES PATENTS 3,887,064 6/1975 Brockmann ..... 432/122

*Primary Examiner*—John J. Camby

[57] ABSTRACT

A heat seal, for a walking beam furnace, comprising a water trough with a pair of parallel skirts having their lower edge portions submerged in the trough. A row of paddles are mounted on each skirt, each paddle being connected pivotably on the skirt for upward and downward movement below the skirt.

5 Claims, 6 Drawing Figures

CLEANING DEVICE FOR WALKING BEAM FURNACE

This invention relates to a walking beam furnace.

In the high temperature heating or reheating of metal slabs, billets or blooms for the production of finished shapes, the slabs are usually moved step by step through a furnace by a walking beam having legs which project upwardly into the furnace hearth through slots in the furnace floor. To prevent heat loss through these slots the underside of the furnace carries a heat seal comprising a fixed pair of parallel skirts which have their lower edge portions submerged in a trough of water mounted on the movable walking beam. A problem encountered with this type of heat seal is that scale and refractory material from the furnance hearth fall through the slots in the furnace floor into the water trough. This debris must be removed during the operation of the furnace to maintain the effectiveness of the seal.

A device presently used for cleaning the water trough comprises a series of fixed paddles depending from the sealing skirts. When the walking beam moves upwardly and forwardly the paddles pass along the bottom of the water trough and push the debris towards a hopper at the end of the trough. However, when a relatively large piece of debris is located directly below a paddle the upward and forward movement of the walking beam causes the large piece of debris to deform the paddle. Consequently the paddles must be frequently repaired which causes expensive shut down time for the furnace.

It is an object of the present invention to provide an improved cleaning device for the heat sealing system of a walking beam furnace.

In its broadest aspect the invention consists of a furnance having a walking beam movable upwardly, forwardly, downwardly and rearwardly in sequence: a heat seal comprising at least one water trough and a pair of parallel skirts having the lower edge portions thereof submerged in the trough; a plurality of paddles mounted in a row on each skirt and depending therefrom into the trough whereby the bottom of the trough is cleaned in the upward and forward movement of the walking beam each of said paddles being mounted pivotably on the skirt for upward and downward movement.

An example embodiment of the invention is shown in the accompanying drawings in which.

Figure 1:
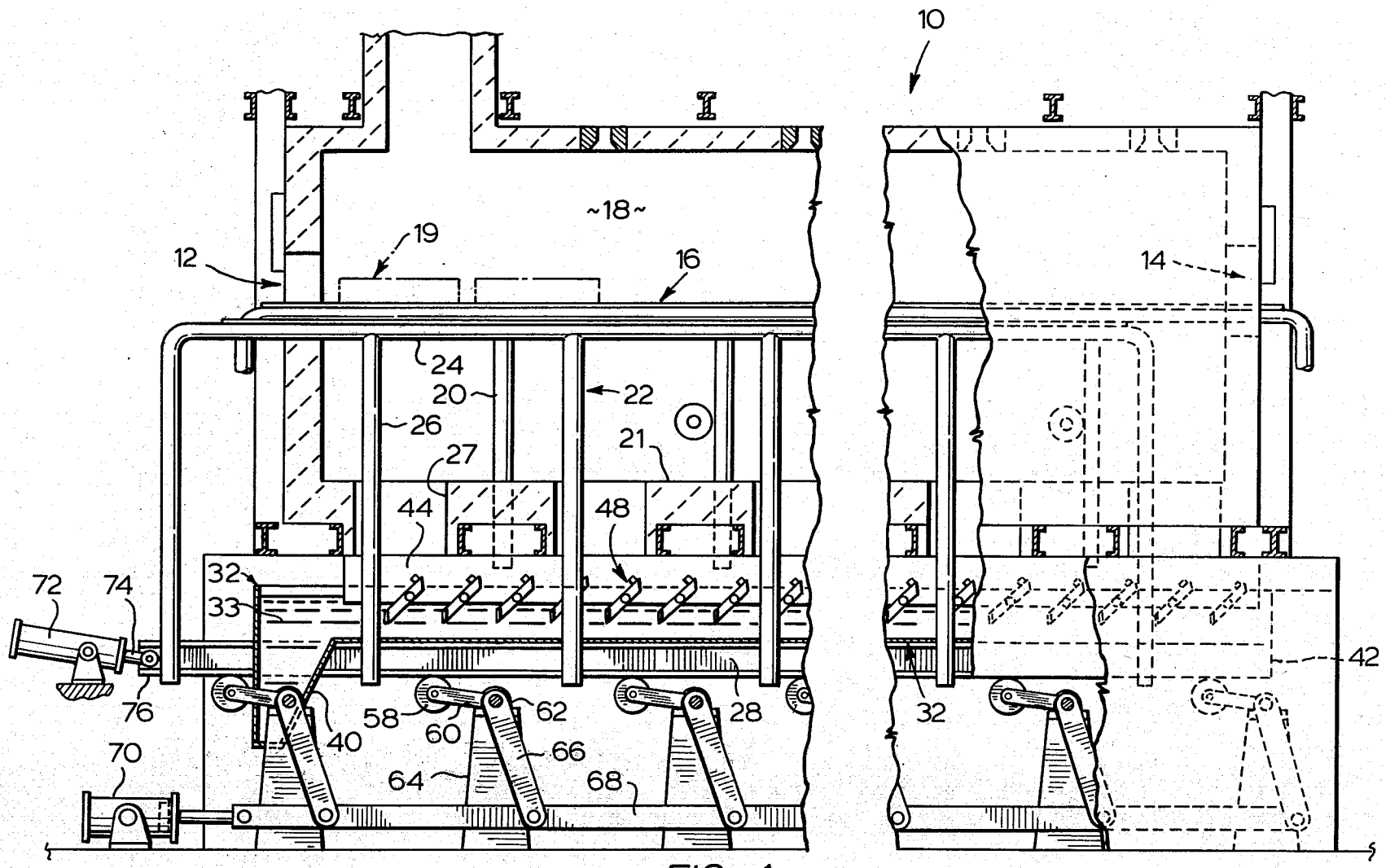
FIG. 1 is a cross-sectional side view in elevation of a reheat furnace with a walking beam in a position of rest.
Figure 4:
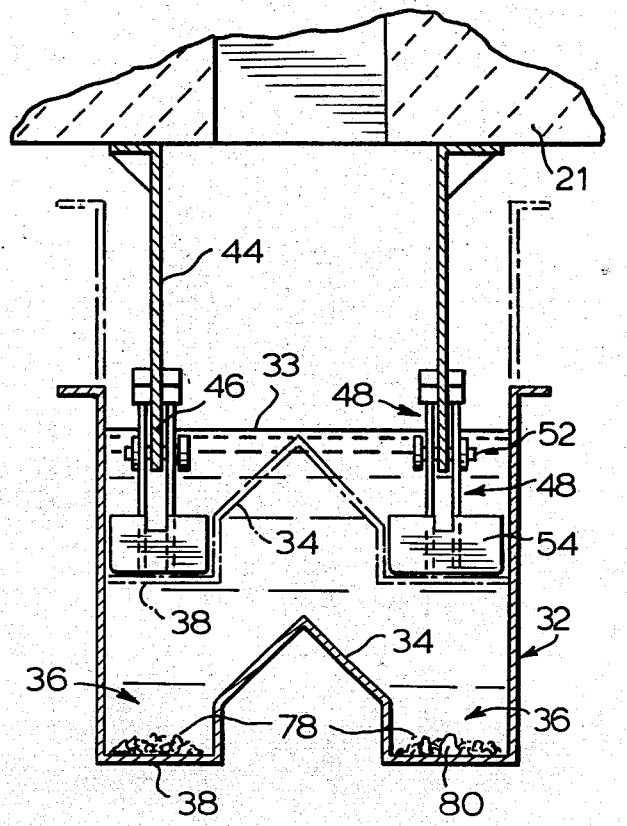
FIG. 4 is a cross-sectional view of the heat seal trough shown in FIGS. 1 to 3.

The example embodiment shown in the drawings consists of a reheating furnace 10 having an entrance 12 and an exit 14 with a spaced pair of parallel rails 16 (usually pipes which are internally water cooled) extending through hearth 18 of the furnace between the entrance and the exit to support metal slabs 19. Rails 16 are supported by vertical pipes 20 fixed in floor 21 of the furnace. A walking beam 22 is located between rails 16 and comprises a spaced pair of rails 24 each supported by a row of vertical legs 26 which pass through a plurality of slots 27 in floor 21 of furnace 10. Legs 26 are fixed at their lower ends on a pair of parellel horizontal beams 28 located beneath floor 21 of furnace 10. Cross-beams 30 carried by beams 28 support a pair of troughs 32 carrying water 33, one trough associated with each row of legs 26. A central upstanding ridge 34 extends along the center line of each trough 32 to form two parallel channels 36 along the bottom 38 of each trough. A discharge hopper 40 is located at one of the two closed ends 42 of trough 32. A pair of parallel skirts 44 fixed to furnace 10 beneath floor 21 have their lower edge portions 46 located within trough 32, one skirt within each channel 36. A row of paddles 48 extends downwardly from the lower edge portion 46 of each skirt 44. Each paddle 48 comprises a sloping arm 50 pivotably attached laterally to skirt 44 by a fulcrum pin 52. A substantially vertical blade 54 with a central notch 55 is fixed to the lower end of arm 50 while the upper end portion of the arm bears upwardly, urged by the weight of blade 54, laterally against a stop member 56 fixed on the skirt. The slope of arm 50 is downwardly and rearwardly treating exit 14 as the forward end of furnace 10 towards which slabs are moved by walking beam 22.

Horizontal beams 28 of walking beam 22 are supported on a plurality of rollers 58 which are journally mounted on a canti-lever arm 60 fixed on a cross-arm 62, resting on fixed supports 64. A crank arm 66 connects each cross-arm 62 with a common piston rod 68 reciprocated horizontally by an hydraulic cylinder and piston assembly 70. A further hydraulic cylinder and piston assembly 72 is connected by a piston rod 74 with an end cross-beam 76 fixed across beams 28.

Figure 2:
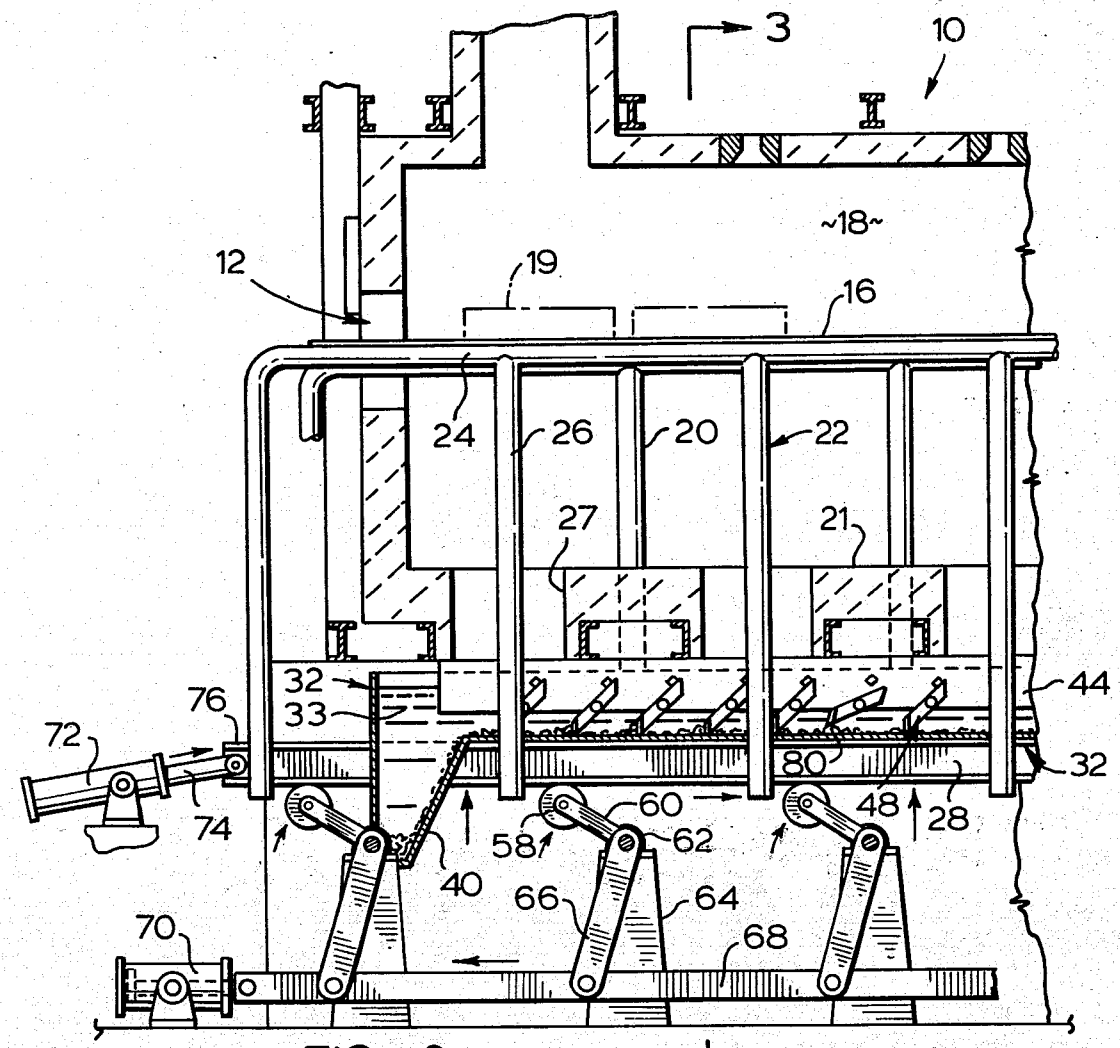
FIG. 2 is a view similar to FIG. 1 showing the walking beam in an upward and forward position.
Figure 5:
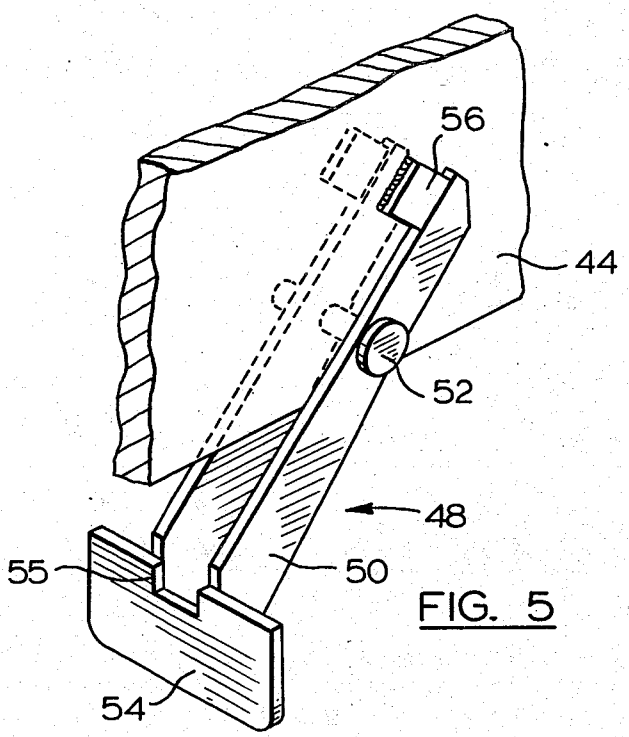
FIG. 5 is a perspective view of a paddle mounted on the skirt of the heat seal shown in FIG. 4.

In the operation of the device of the example embodiment debris 78 from furnace 10, which falls through slots 27, rests on bottom 38 in channels 36 of each trough 32. Walking beam 22 is moved by jacks 70 and 72 through a rectangular travel cycle in the vertical longitudinal axial plane of the furnace 10. In the first step rod 68 is moved to the left which causes rollers 58 to raise horizontal beams 28 vertically, and in the second step rod 74 moves beams to the right, as seen in FIG. 2. In the third step rod 68 is moved to the right which lowers horizontal beams 28 and in the fourth step rod 74 is moved to the left which returns walking beam 22 to its original position of rest as seen in FIG. 1. As walking beam 22 moves upwardly on the first leg of its cycle, paddle blades 54 meet bottom 38 of trough 32 in channels 36. On the second leg of its cycle the forward movement of walking beam 22 will cause paddles 48, which are fixed against horizontal movement, to push debris 78 along each channel 36. In this manner succeeding cycles of walking beam 22 will cause debris 78 to be pushed intermittently but regularly along trough 32 until the last paddle 48 pushes the debris into well 40 at the end of the trough.

Any relatively larger piece of debris 80 meeting one of blades 54 on the upward movement of walking beam 22 will cause paddle 48 carrying that blade to pivot about fulcrum pin 52 clockwise as seen in FIG. 1 and 2. During the second leg of the cycle of walking beam 22 the large piece of debris 80 will move with trough 32 from beneath the particular paddle blade 54 at which time the paddle will pivot downwardly until arrested by stop 56. The particular piece of debris 80 will be caught by the next paddle 48. The ability of each paddle 48 to yield under this type of pressure will prevent its damage and extend its life, thus avoiding costly repairs.

Figure 6:
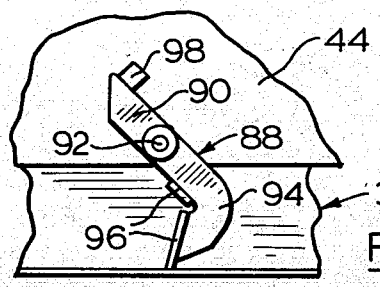
FIG. 6 is a side view in elevation showing an alternate embodiment of the paddle of FIG. 5.
Figure 3:
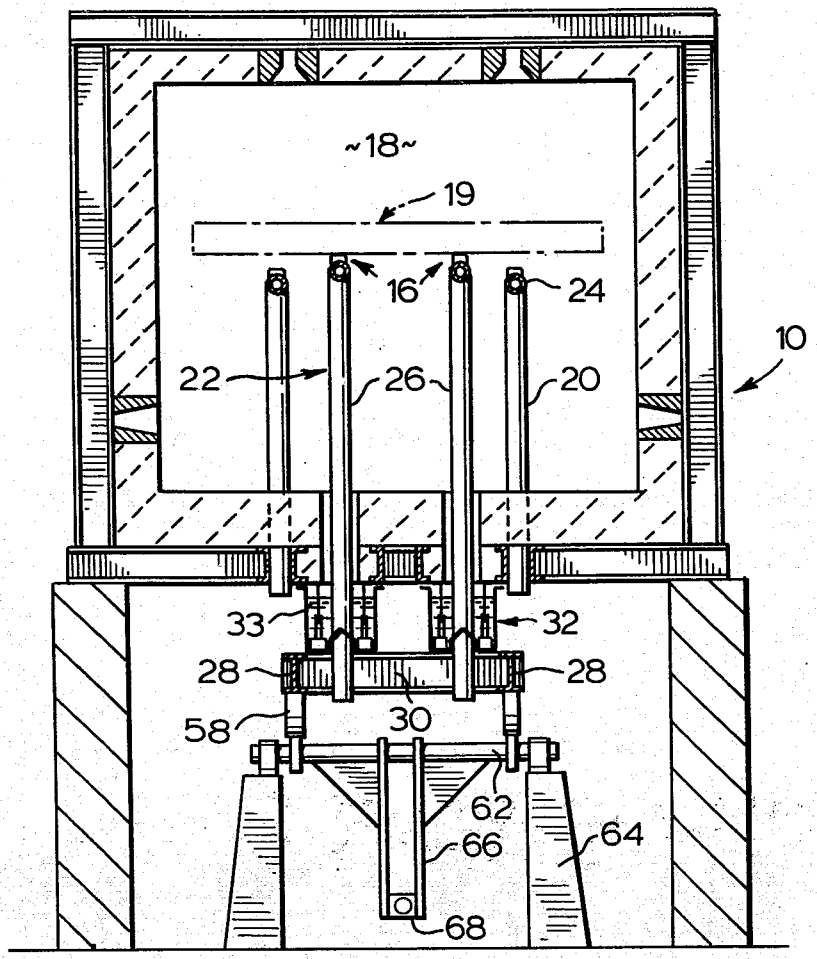
FIG. 3 is a cross-sectional view taken along line 3—3 of FIG. 2.

The alternate embodiment shown in FIG. 6 of the drawings comprises a paddle 88 having an arm 90 which slopes downwardly and forwardly, the arm being pivotally attached laterally to skirt 40 by a fulcrum pin 92. The lower end portion of arm 90 is angled to form a brace 94 to which a substantially vertical blade 96 is fixed. The upper end portion of arm 90 bears upwardly, urged by the weight of blade 96, laterally against a stop member 98. The slope of arm 50 is downwardly and forwardly treating exit 14 as the forward end of furnace 10.

In the operation of the alternate embodiment of FIG. 6 a relatively larger piece of debris meeting one of blades 96 on the upward movement of walking beam 22 will cause paddle 88 carrying that blade to pivot about fulcrum pin 92 counterclockwise as seen in FIG. 6. Subsequent steps in the cycle of walking beam 22 will clear the larger piece of debris from beneath paddle 96 and move the debris along trough 32 to hopper 40, as in the previous embodiment.

it will be appreciated that the invention is also employable in a furnace where the water trough is fixed to the furnace structure and the skirts are associated with the walking beam and are movable.

I claim:

1. In a furnace having a walking beam movable upwardly, forwardly, downwardly and rearwardly in sequence; a heat seal comprising at least one water trough and a pair of parallel skirts having the lower edge portions thereof submerged in the trough; a plurality of paddles mounted in a row on each skirt and depending therefrom into the trough whereby the bottom of the trough is cleaned in the upward and forward movement of the walking beam, means mounting each of said paddles pivotally on the skirt for free upward and downward movement relative to the skirt, and stop means mounted on the skirt limiting the paddle in said downward movement.

2. A reheat furnace as claimed in claim 1 in which each of said paddles is urged downwardly by the weight thereof against said stop means.

3. A reheat furnace as claimed in claim 2 in which each of said paddles comprises a downwardly sloping arm pivotably connected laterally to the skirt intermediate the ends of the arm, the lower end of the arm having a paddle blade fixed thereon transverse to the axis of the trough, the upper end of the arm abutting said stop member fixed to the skirt whereby a force acting horizontally against the paddle pivots the arm against the stop members and a force acting vertically against the paddle pivots the army away from the stop member and moves the blade upwardly towards the skirt.

4. A heat seal as claimed in claim 3 in which the arm slopes downwardly and rearwardly.

5. A heat seal as claimed in claim 4 in which the arm slopes downwardly and forwardly.

* * * * *